US005881946A

United States Patent [19]

Cürten et al.

[11] Patent Number: 5,881,946

[45] Date of Patent: Mar. 16, 1999

[54] METHOD OF MANUFACTURING A HOLLOW SPINDLE

[75] Inventors: Franz Cürten, Langenfeld; Dieter Wittenberg, Wilnsdorf; Martin Kiessling, Burbach; Günter Mally, Hamm, all of Germany

[73] Assignee: Mannesmann Aktiengesellschaft, Düsseldorf, Germany

[21] Appl. No.: 793,162

[22] PCT Filed: Jul. 19, 1995

[86] PCT No.: PCT/DE95/00986

§ 371 Date: Mar. 10, 1997

§ 102(e) Date: Mar. 10, 1997

[87] PCT Pub. No.: WO96/05004

PCT Pub. Date: Feb. 22, 1996

[30] Foreign Application Priority Data

Aug. 8, 1994 [DE] Germany ..... 44 28 875.1

[51] Int. Cl.[6] ..... B23K 1/00; B23K 31/02

[52] U.S. Cl. ..... 228/132; 228/173.4; 228/232

[58] Field of Search ..... 228/132, 131, 228/173.4, 232

[56] References Cited

U.S. PATENT DOCUMENTS 2,007,597 7/1935 Dean ..... 228/173.4

3,394,445 7/1968 Valyi ..... 228/173.4

4,934,579 6/1990 Doble ..... 228/131

OTHER PUBLICATIONS

*Tempil Basic Guide to Ferrous Metallurgy*, Tempil Division, Big Three Industries, Inc., 1977.

*Primary Examiner*—Patrick Ryan

*Assistant Examiner*—Jeffrey T. Knapp

*Attorney, Agent, or Firm*—Cohen, Pontani, Lieberman & Pavane

[57] ABSTRACT

A method of manufacturing a hollow spindle, especially for the pivotal mounting of valve-actuating levers to control exhaust-and-intake valves of an internal combustion engine. The spindle has an outer tube, in the interior of which a shaped tubular body is fixed in order to form at least two liquid-carrying chambers. To form a chamber, the tubular body is provided with a cutout extending in the longitudinal direction. The tubular body is a shaped inner tube that, seen in cross-section, has an inwardly-curved region that makes a rounded and stepless transition to the circular region, and of the tubular body. At least the circular region is joined by virtue of its material to the outer tube.

8 Claims, 1 Drawing Sheet

METHOD OF MANUFACTURING A HOLLOW SPINDLE

BACKGROUND OF THE INVENTION

1. Field of the Invention

The invention relates to a method of manufacturing a hollow spindle that serves, in particular, as the mounting for valve-actuating levers that control exhaust-and-intake valves in an internal combustion engine.

2. Description of the Prior Art

A hollow spindle, specifically a rocker lever spindle of the aforementioned type, is known from DE 42 21 708 A1. This rocker lever spindle consists of an outer tube, in the interior of which a shaped tubular body is fixed. By means of the tubular body, which has a longitudinal rib, at least two and preferably three liquid-carrying chambers are formed. In a special embodiment (FIG. 2), the tubular body has a roughly V-shaped cutout that extends in the longitudinal direction to form a chamber. The tubular body is pushed or pressed into the outer tube and fixed in place by cam-type elevations or shapings on the mantle of the tubular body. A disadvantage of this design is that there is no assurance that the fixed position of the tubular body will be maintained or that the chambers will remain sealed under operating conditions. Furthermore, the lengths that can be manufactured are limited, so that production costs are high.

U.S. Pat. Nos. 3,863,328 and 4,125,924, disclose a method for fitting two tubes together in a rattle-proof fashion. After one tube is slipped into the other with a certain diameter clearance, a drawing point is formed on one end of the tubes. The tubes are then cold-drawn one atop the other.

SUMMARY OF THE INVENTION

It is an object of the present invention to provide a method for manufacturing a hollow spindle, particularly for the pivotal mounting of valve-actuating levers, in which the fixed position and the sealing of the chambers are maintained even under operating conditions and which allows longer lengths to be economically produced.

Pursuant to this object, and others which will become apparent hereafter, one aspect of the present invention resides in a method of manufacturing a hollow spindle by providing an outer tube, forming an inner tube having a circumference with an inwardly curved region and a circular region, the inwardly curved region being configured to pass into the circular region in a rounded, stepless manner, sliding the inner tube into the outer tube, cold drawing the outer tube onto the inner tube, heat treating the inner tube and the outer tube in a reducing atmosphere, adding a soldering agent, and final annealing the tubes to melt the soldering agent and fix the inner tube to the outer tube so that two liquid-carrying chambers are formed.

The hollow spindle produced according to the present invention that is distinguished by the fact that, instead of an inserted shaped section, a shaped inner tube rigidly connected to the outer tube by virtue of its material is used to form two chambers. The shaped inner tube, seen in cross-section, has an inwardly curved region. The inwardly curved region makes a rounded and stepless transition to the circular region. The two chambers are sealed by a soldered layer, which is provided over the entire circumferential area of the inner surface of the outer tube that comes to rest against the inner tube, as well as over the outer surface of the inner tube. Both the outer tube and the inner tube are preferably made of steel. However, other materials are also conceivable, such as Cu, Al and combinations with steel. In many cases, a hollow spindle that is used as a rocker lever spindle must be partially subjected to induction hardening. In these cases, the outer tube is preferably made of heat-treated steel.

The advantage of the method according to the invention is that the shaped inner tube can be economically drawn or rolled, whereas the inserted profile according to the prior art must be produced in an expensive extrusion process. Because a soldered layer is applied to the entire circumference that comes to rest, the requisite impermeability of the chambers is ensured. The cold drawing of tubes placed one inside the other serves to draw the tubes one atop the other in a rattle-proof manner. It is important, when this is done, that the two metal surfaces being pressed together be as metallically bare as possible and have no foreign particles between them. This is achieved by bright-annealing both the outer tube and the inner tube in a reducing atmosphere prior to putting the two tubes together. In addition, this heat treatment may be preceded by a degreasing process to ensure that no lubricant cracking residues remain on the surface. To ensure that the inner tube, except for its inwardly curved region, comes to rest against the circumference of the outer tube, the curved region should not have an overly acute angle. A minimum opening angle of 60° and a minimum curvature radius of 2.5 mm have proved advantageous for the curved region. Otherwise, the resilience of the curved region is too great, despite the support of an internal die, and a certain portion of the transitional area does not come to rest.

In order to keep the chambers tightly sealed, as mentioned above, the inner surface of the outer tube and the outer surface of the inner tube are provided with an intervening soldered layer. For this purpose, the mantle surface of the inner tube can be galvanically copper coated prior to the tubes being placed together, for example. Alternatively, it is also possible to apply soldering paste or enclose the inner tube in a soldering foil or sprinkle soldering powder on the bare surface. This last method can be further supported by electrostatic charging. The actual soldering is then carried out by means of annealing after the cold drawing. This annealing may be a heat treatment that would be needed after cold drawing, or it may be an annealing during the course of induction hardening. In addition or alternatively, the gap in the transitional area between the curved region of the inner tube and the supporting region of the outer tube can be filled with solder. For this purpose, a soldering wire, especially made of copper, is placed into the smaller chamber formed by the inner tube, and the tube is then annealed. The high temperature (in the range of 1100° C.) needed for annealing when a hard solder of Cu is used can lead, depending on the grade of steel, to coarse grain growth. To largely eliminate this phenomenon, that a normalizing annealing is carried out after soldering. Alternatively, it is also possible to use silver solder with a low melting point, so that the annealing for soldering purposes corresponds to a standard final heat treatment at approximately 950° and there is no danger of coarse grain growth. The higher costs associated with the silver solder are balanced by the elimination of further heat treatment. It should be noted that when silver solder is used, a flux material is often necessary. Depending on how a particular hollow spindle is to be used, this is often undesirable, because the residues of the flux agent can lead to unwanted chemical reactions.

The manufacture of a hollow spindle according to the invention is described in greater detail below in reference to an example. In this example, the hollow spindle has an outer diameter of 24 mm and a wall thickness of 5.0 mm.

EXAMPLE

Starting from a cold-finished outer tube of heat-treatment st e.g., Ck 45, having an outer diameter (Da A) of 26.1 mm and a wall thickness of 3.8 mm the outer tube is subjected to normalizing annealing in a reducing atmosphere. Parallel to this, a shaped inner tube of structural steel, e.g., St 35, having an outer diameter (Da I) of 17.5 mm and a wall thickness of 1.7 mm is produced by cold drawing. The inner tube is also subjected to heat treatment in a reducing atmosphere. Before the inner tube is placed into the outer tube, the outer surface of the inner tube is galvanically copper coated. The inner tube is then inserted into the outer tube and a drawing point is formed. To ensure that the (already formed) curvature of the inner tube rests against the outer tube, beginning at the transitional area, with the fewest possible interruptions, a suitable internal die is used for support during cold drawing. For inner lubrication, a certain amount of lubricant is deposited in the inner tube. For outer lubrication, circulating lubrication is used. After the cold drawing, the hollow spindle that has been created has an outer diameter of 24 mm and a total wall thickness of 5 mm. In order to join the two tubes that are drawn together in rattle-proof fashion in a material locking fashion, the hollow spindle is annealed at 1100° C. for the purpose of soldering. In addition, a soldering wire can be placed in the chamber formed by the curvature, in order to ensure that the interstitial area in the transitional region of the curvature and the circular inner tube is also filled with solder. If necessary, a final normalizing treatment can be carried out to eliminate any coarse grain that may have formed.

DETAILED DESCRIPTION OF THE PREFERRED EMBODIMENTS

Figure 1:
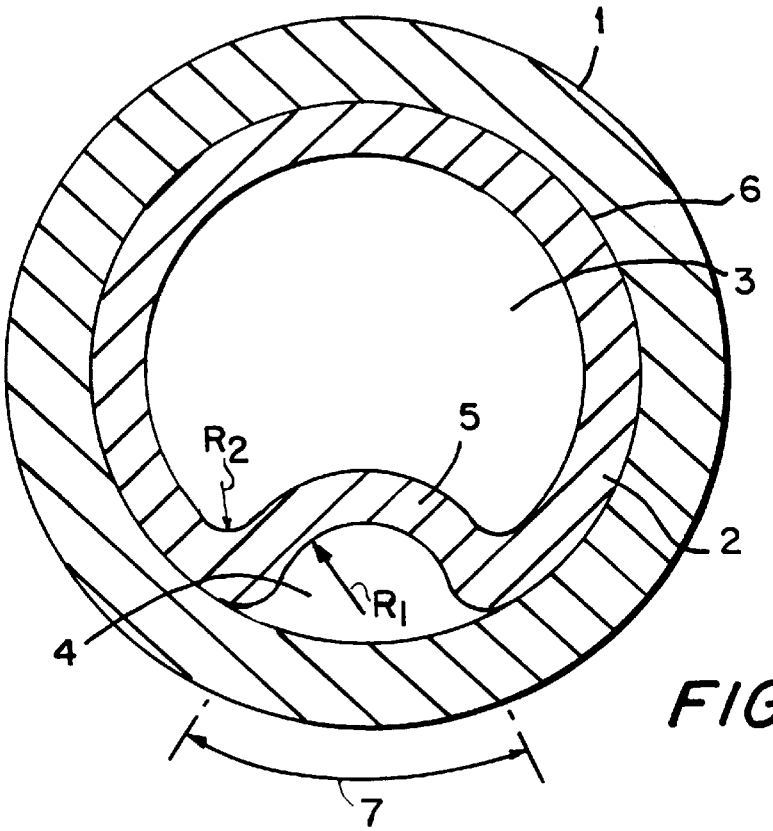
FIG. 1 is a cross-section of a hollow spindle produced by the inventive method.
Figure 2:
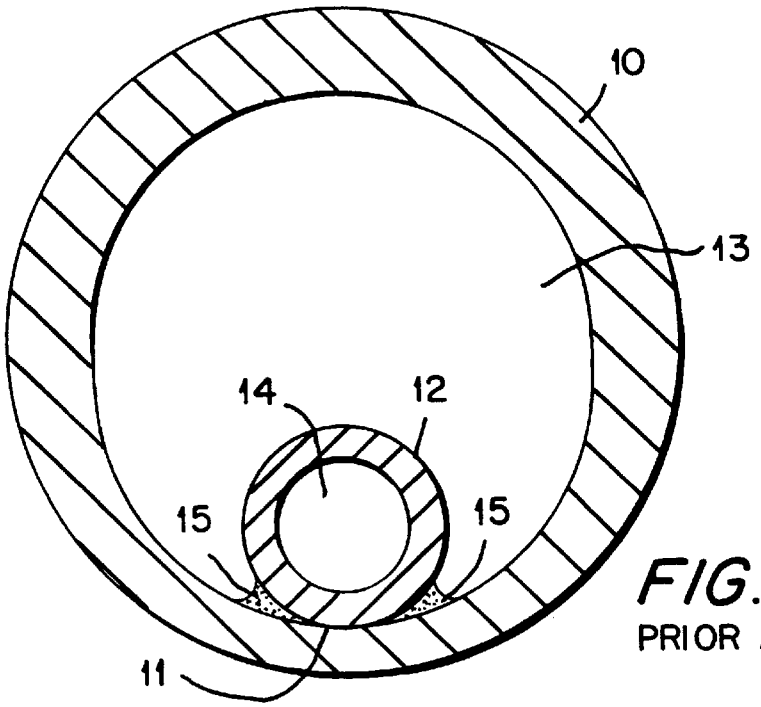
FIG. 2 PRIOR ART
FIG. 2 is a cross-section of a hollow spindle produced by a prior art method.

In cross-section, FIG. 1 shows a finished hollow spindle based on the inventive manufacturing method. The hollow spindle has an outer tube 1 of a heat-treatment steel Ck 45, for example, and a shaped inner tube 2 of St 35, for example. As described above, the two tubular bodies have been cold drawn one atop the other in a rattle-proof fashion. The shaped inner tube 2, together with the outer tube 1, forms two chambers 3, 4. The cross-section of the smaller chamber 4 is limited by an inner circumferential area of the outer tube 1 and an outer circumferential area of the inward curvature 5 of the inner tube 2. The curved region 5 passes in rounded fashion into the circular region 6 of the inner tube 3. In the ideal case, this circular region 6 comes completely to rest against the inner side of the outer tube 1. The actual extent of contact is heavily influenced by the nature of the curvature 5. The curvature 5 should not have too sharp an angle or be insufficiently rounded. An opening angle 7 of at least 60° and a curvature radius $R_1$ of at least 2.5 mm have proved advantageous for the curvature. The rounding radius $R_2$ in the curvature transitional region should be no smaller than 0.5 mm. Otherwise, because of the resilience of the curvature 5, the danger exists that the transitional area 8 will not come to rest. When the hollow spindle is to be used as a rocker lever spindle to control exhaust-and-intake valves, the chambers 3, 4 are bored at different locations. This requires the seal between the chambers 3, 4 to be as free of gaps as possible.

The proposed material connection between the inner tube 2 and the outer tube 1 has the advantage that the total wall, i.e., the wall of the outer tube 1 plus the wall of the inner tube 2, can be taken into account in calculating the carrying capacity of the hollow spindle. This permits the wall thickness of the outer tube 1 to be reduced and results in corresponding savings in weight. The rib to increase rigidity usually provided in the prior art can therefore be omitted.

We claim:

1. A method of manufacturing a hollow spindle, comprising the steps of:

providing an outer tube;

forming an inner tube having a circumference with an inwardly curved region and a circular region, the inwardly curved region being configured to pass into the circular region in a rounded, stepless manner;

sliding the inner tube into the outer tube;

cold drawing the outer tube onto the inner tube;

heat treating the inner tube and the outer tube in a reducing atmosphere;

adding a soldering agent; and final annealing the tubes to melt the soldering agent and fix the inner tube in the outer tube so that two liquid-carrying chambers are formed.

2. A method as defined in claim 1, wherein the forming step includes shaping the inner tube by cold drawing.

3. A method as defined in claim 1, wherein the forming step includes shaping the inner tube by cold rolling.

4. A method as defined in claim 1, and further comprising the step of coating an outer surface of the inner tube with one of an element and alloy from the group consisting of copper, silver and gold, prior to the sliding step.

5. A method as defined in claim 1, wherein the cold drawing step includes supporting the inner tube shape with an internal die.

6. A method as defined in claim 1, wherein the step of adding soldering agent includes, prior to the final annealing step, inserting a solder wire into a smaller of the chambers formed by the inner tube.

7. A method as defined in claim 1, and further comprising the step of, after the soldering agent adding step, subjecting at least a section of the hollow spindle to a normalizing annealing.

8. A method as defined in claim 7, wherein the normalizing annealing step includes subjecting the entire hollow spindle to normalizing annealing.

* * * * *